US009767976B2

(12) United States Patent
Fang et al.

(10) Patent No.: US 9,767,976 B2
(45) Date of Patent: Sep. 19, 2017

(54) POLAR RELAY

(71) Applicant: Tyco Electronics (Shenzhen) Co., Ltd, Shenzhen (CN)

(72) Inventors: Guangcheng Fang, Shenzhen (CN); Xiaoning Zhang, Shenzhen (CN)

(73) Assignee: Tyco Electronics (Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/240,369

(22) Filed: Aug. 18, 2016

(65) Prior Publication Data

US 2017/0053761 A1 Feb. 23, 2017

(30) Foreign Application Priority Data

Aug. 18, 2015 (CN) ..... 2015 1 0507035

(51) Int. Cl.
*H01H 51/22* (2006.01)
*H01H 50/16* (2006.01)

(52) U.S. Cl.
CPC ..... *H01H 51/2227* (2013.01); *H01H 50/163* (2013.01)

(58) Field of Classification Search
CPC ..... H01H 50/24; H01H 50/36; H01F 7/122; H01F 7/14; H01F 7/1646
See application file for complete search history.

(56) References Cited

U.S. PATENT DOCUMENTS 3,993,971 A * 11/1976 Ono ..... H01H 50/58 335/125
4,206,431 A * 6/1980 Kimpel ..... H01H 51/2227 335/80
8,148,856 B2 * 4/2012 Bataille ..... H02K 35/02 290/1 R
9,293,973 B2 * 3/2016 Tsukanaka ..... H02K 21/14

* cited by examiner

*Primary Examiner* — Bernard Rojas
(74) *Attorney, Agent, or Firm* — Barley Snyder

(57) ABSTRACT

A polar relay is provided including: an insulation housing, an armature assembly, and a coil assembly. The armature assembly is pivotably mounted within the insulation housing. The armature assembly is rotatable between a first position and a second position, with one end of the iron core in contact with one armature of the pair of armatures while the other end of the iron core is spaced apart from and thus out of contact with the pair of armatures by corresponding gaps therebetween. The gaps are provided without providing a magnetic isolation plate between or applying an isolation layer onto contact layers of the armature and the iron core. The armature assembly is rotatable around a vertical pivot axis, avoiding changing a position of the pivot point during the movement of the iron core, stabilizing the action of the armature assembly, and ensuring the continuity of the action of the product.

19 Claims, 5 Drawing Sheets

POLAR RELAY

CROSS-REFERENCE TO RELATED APPLICATION

This application claims the benefit of the filing date under 35 U.S.C. §119(a)-(d) of Chinese Patent Application No. 201510507035.9 filed on Aug. 18, 2015.

FIELD OF THE INVENTION

Embodiments of the present invention relate to a polar relay, and especially to a monostable polar relay.

BACKGROUND

In general, a polar relay comprises an insulation housing, a coil assembly accommodated within the insulation housing, an armature assembly, and a plurality of groups of contact assemblies. The coil assembly comprises a coil and an iron core. In the prior art, a coil is typically mounted into an insulation base of the insulation housing in a top-down installation manner, and the iron core is inserted into the coil.

Nowadays, a commercially available polar relay is typically arranged in a form of an I-shaped magnetic circuit configuration, with one end of the iron core functioning as a pivot point and the other end of the iron core being pivotable around the pivot point. With such magnetic circuit configuration, firstly, it is necessary to provide a magnetic isolation plate between the armature and the iron core, or to apply an isolation layer onto contact layers between the armature and the iron core when this magnetic circuit configuration is used for a monostable product. A magnetic isolation plate or an isolation layer prevents a resultant electromagnetic force from increasing steeply and hence ensures a normal release of the product, but leads to a higher cost. Secondly, it is possible that a position of the pivot point is changed during movement of the iron core, resulting in a non-continuous course of action of the relay product.

SUMMARY

The present invention has been made to overcome or alleviate at least one aspect of the above mentioned disadvantages and/or shortcomings.

One object of the present invention, amongst others, is to provide a polar relay which may not only decrease manufacturing cost thereof but also maintain action continuous thereof.

According to an aspect of the present invention, there is provided a polar relay, comprising an insulation housing; an armature assembly mounted in the insulation housing, and comprising a pair of armatures, a magnet located between the pair of armatures and a plastic body holding the pair of armatures and the magnet together; and a coil assembly mounted in the insulation housing, and comprising a coil and an iron core inserted into the coil. One end of the iron core extends between first ends of the pair of armatures while the other end of the iron core extends between second ends of the pair of armatures. The armature assembly is pivotably mounted within the insulation housing such that the armature assembly is rotatable between a first position and a second position. The one end of the iron core is in contact with one armature of the pair of armatures while the other end of the iron core is spaced apart from and thus out of contact with the pair of armatures by corresponding gaps therebetween, when the armature assembly is located at one of the first position and the second position.

BRIEF DESCRIPTION OF THE DRAWINGS

The above and other features and advantages of the present invention will become more apparent and a more comprehensive understanding of the present invention can be obtained, by describing in detail exemplary embodiments thereof with reference to the accompanying drawings, in which.

DETAILED DESCRIPTION OF THE EMBODIMENT(S)

Figure 1:
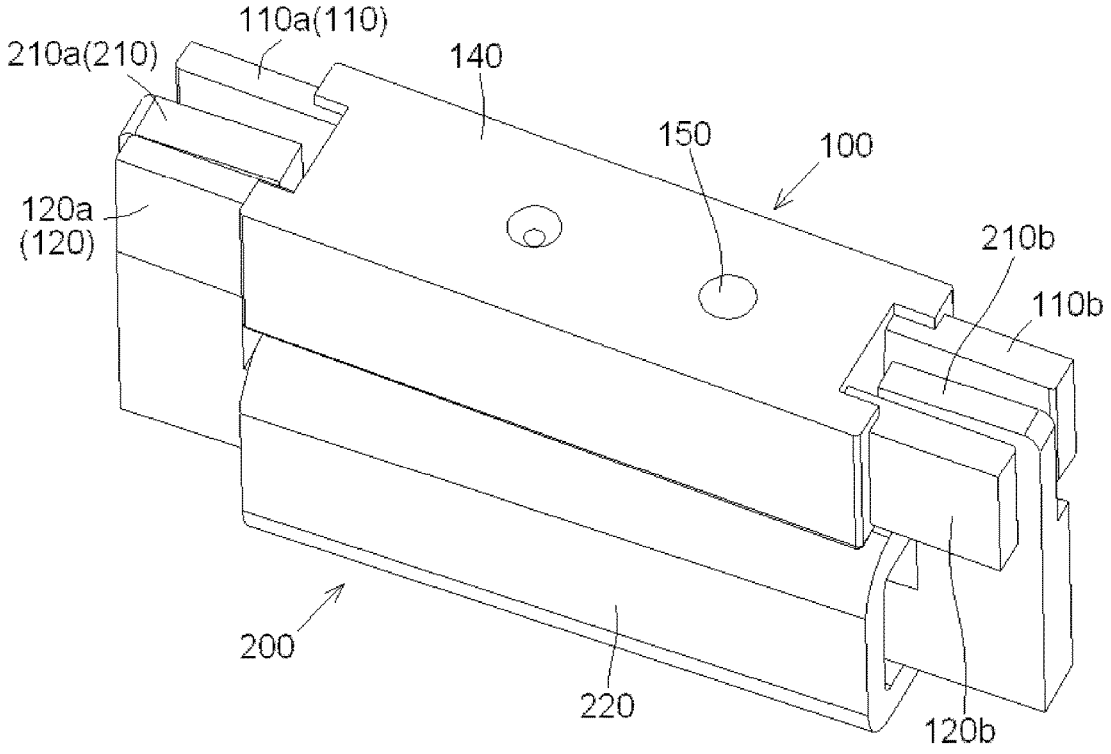
FIG. 1 illustrates a schematic perspective view of a polar relay according to an exemplary embodiment of the present invention, wherein only an armature assembly and a coil assembly are shown.

Exemplary embodiments of the present disclosure will be described hereinafter in detail with reference to the attached drawings, wherein the like reference numerals refer to the like elements. The present disclosure may, however, be embodied in many different forms, and thus the detailed description of the embodiment of the invention in view of attached drawings should not be construed as being limited to the embodiment set forth herein; rather, these embodiments are provided so that the present disclosure will be thorough and complete, and will fully convey the general concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to a general technical concept of the present invention, there is provided a polar relay, comprising an insulation housing; an armature assembly mounted in the insulation housing, comprising a pair of armatures, a magnet located between the pair of armatures and a plastic body holding the pair of armatures and the magnet together; and a coil assembly mounted in the insulation housing, comprising a coil and an iron core inserted therein. One end of the iron core extends to be interposed between respective first ends of the pair of armatures while the other end of the iron core extends to be interposed between respective second ends of the pair of armatures. The armature assembly is pivotably mounted within the insulation housing such that the armature assembly is rotatable between a first position and a second position. The one end of the iron core is configured to be in contact with one armature of the pair of armatures whereas the other end of the iron core is configured to be spaced apart from and thus out of contact with the pair of armatures by corresponding gaps therebetween, as the armature assembly is located at one of the first position and the second position.

FIG. 1 illustrates a schematic perspective view of a polar relay according to one exemplary embodiment of the present invention, wherein only an armature assembly 100 and a coil assembly 200 are shown.

In an exemplary embodiment of the present invention, a polar relay is disclosed. As illustrated in FIG. 1, the polar relay mainly comprises an insulation housing (not illustrated), an armature assembly 100, a coil assembly 200 and a contact assembly (also not illustrated). The armature assembly 100, the coil assembly 200 and the contact assembly are mounted within the insulation housing.

Figure 2:
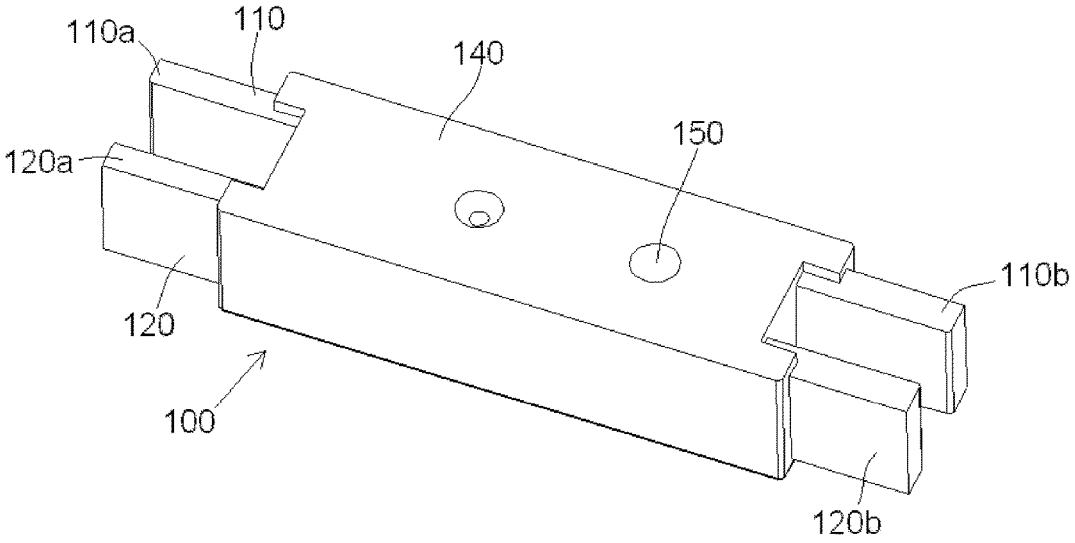
FIG. 2 illustrates a schematic perspective view of the armature assembly as shown in FIG. 1.
Figure 3:
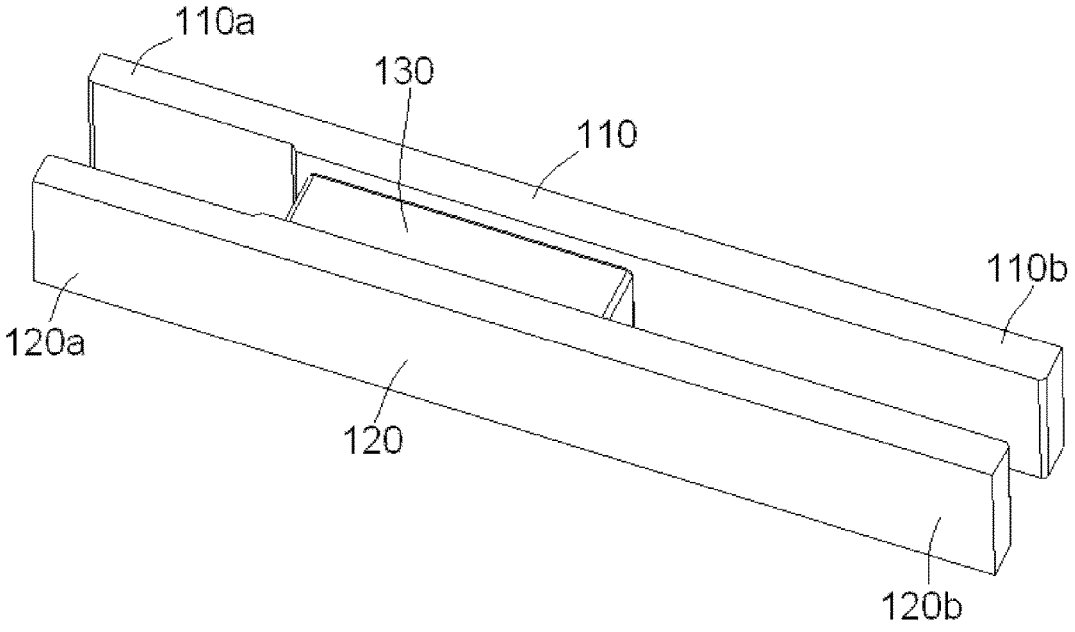
FIG. 3 illustrates a pair of armatures and a magnet of the armature assembly as shown in FIG. 2.

FIG. 2 illustrates a schematic perspective view of the armature assembly 100 as shown in FIG. 1; and FIG. 3 illustrates a pair of armatures 110, 120 and a magnet 130 of the armature assembly 100 as shown in FIG. 2.

As illustrated in FIGS. 1, 2 and 3, in an illustrated exemplary embodiment, the armature assembly 100 comprises a pair of armatures 110, 120, a magnet 130 located between the pair of armatures 110, 120, and a plastic body 140 constructed to hold the pair of armatures 110, 120 and the magnet 130 together. As can be seen in FIGS. 2 and 3, a pair of armatures 110, 120 comprises a first armature 110 and a second armature 120 which are arranged to be in parallel with and face each other.

Figure 4:
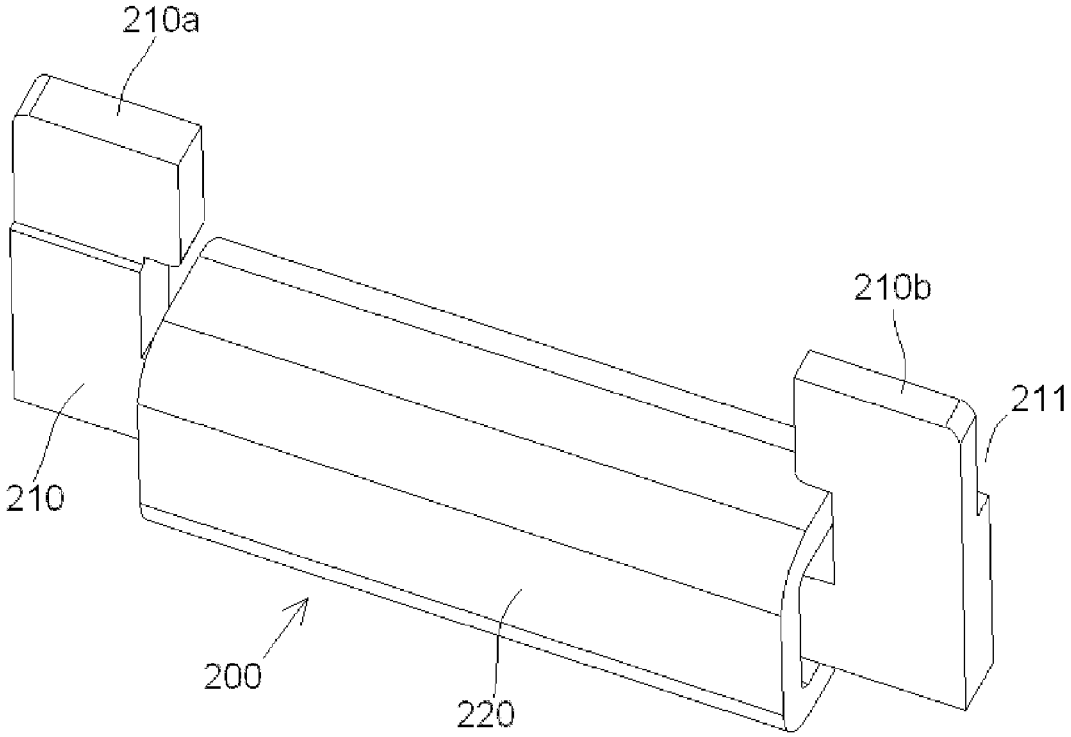
FIG. 4 illustrates a schematic perspective view of the coil assembly as shown in FIG. 1.

FIG. 4 illustrates a schematic perspective view of the coil assembly 200 as shown in FIG. 1.

As illustrated in FIGS. 1 and 4, in an exemplary embodiment of the present invention, the coil assembly 200 comprises a coil 220 and an iron core 210 passing through the coil 220.

As illustrated in FIGS. 1-4, in an exemplary embodiment of the present invention, one end 210*a* of the iron core 210 extends to be interposed between first ends 110*a*, 120*a* of the pair of armatures 110, 120 while the other end 210*b* of the iron core 210 extends to be interposed between second ends 110*b*, 120*b* of the pair of armatures 110, 120.

Figure 7:
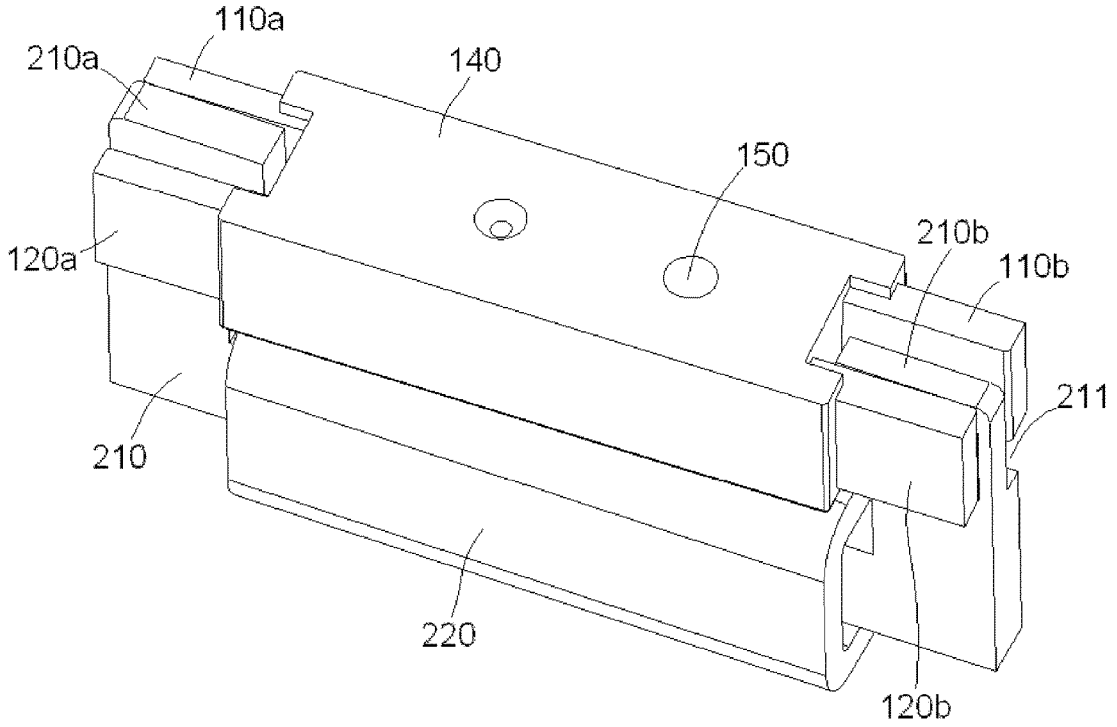
FIG. 7 illustrates a schematic perspective view of the armature assembly and the coil assembly when the coil is not energized.
Figure 8:
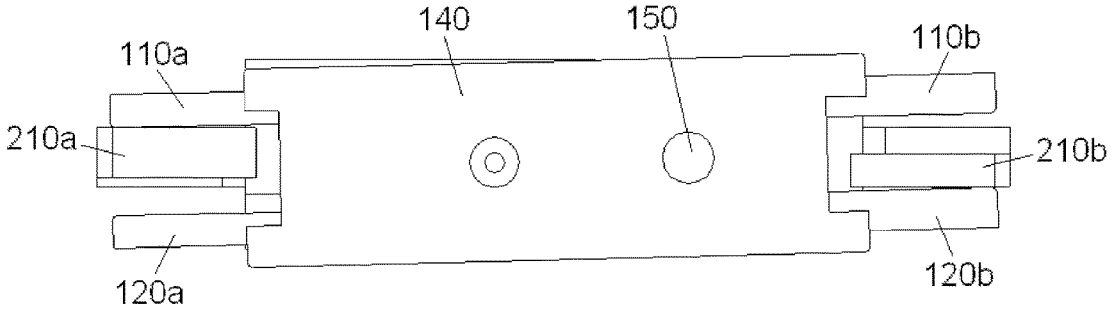
FIG. 8 illustrates a top view of the armature assembly and the coil assembly as shown in FIG. 7.

As illustrated in FIGS. 1-3, a pivot hole is formed in the plastic body 140 of the armature assembly 100 and a pivot shaft 150 is formed on the insulation housing. The pivot shaft 150 is assembled into the pivot hole, such that the armature assembly 100 is configured to be rotatable around the pivot shaft 150 between the first position (i.e., a position as illustrated in FIGS. 5 and 6) and the second position (i.e., a position as illustrated in FIGS. 7 and 8).

Figure 5:
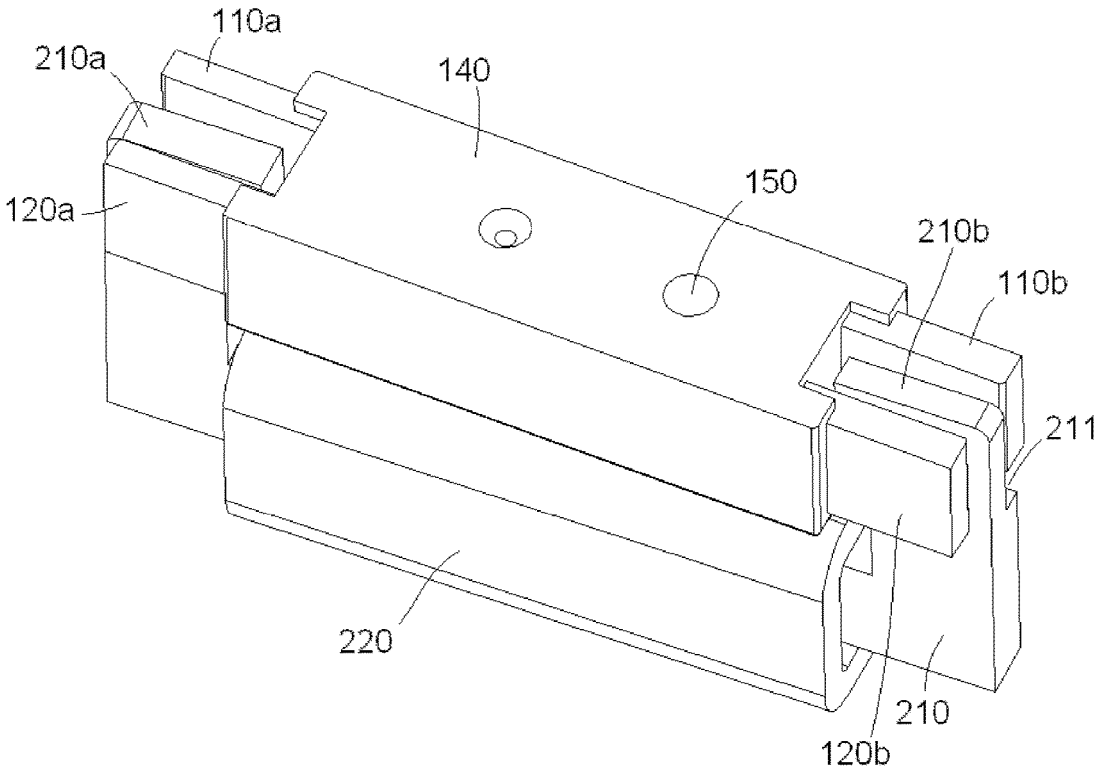
FIG. 5 illustrates a schematic perspective view of the armature assembly and the coil assembly when the coil is energized.
Figure 6:
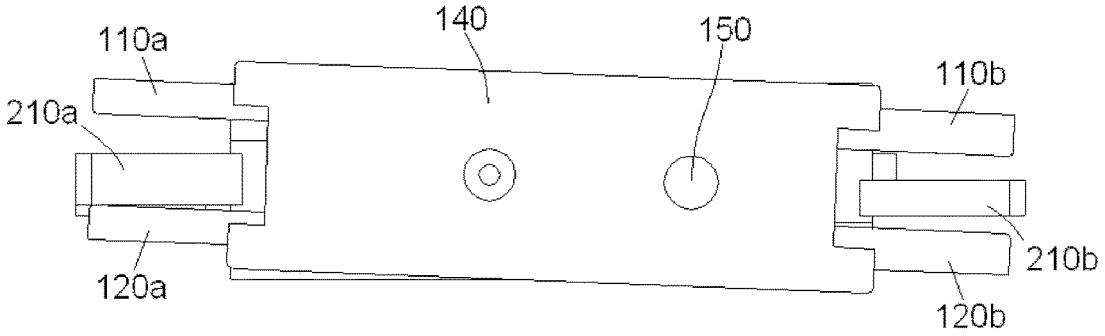
FIG. 6 illustrates a top view of the armature assembly and the coil assembly as shown in FIG. 5.

FIG. 5 illustrates a schematic perspective view of the armature assembly 100 and the coil assembly 200 when the coil 220 is energized; and FIG. 6 illustrates a top view of the armature assembly 100 and the coil assembly 200 as shown in FIG. 5.

In an exemplary embodiment as illustrated, the polar relay is a monostable polar relay. As far as such monostable polar relay is concerned, when the coil 220 is energized, as illustrated in FIGS. 5 and 6, the armature assembly 100 is rotated to the first position under action of an inductive magnetic force induced by the coil 220.

As also shown in FIGS. 5 and 6, in an exemplary embodiment as illustrated, when the armature assembly 100 is located at the first position, i.e., when the coil 220 is energized, the one end 210*a* of the iron core 210 is in contact with the first end 120*a* of the second armature 110 of the pair of armatures 110, 120 while the other end 210*b* of the iron core 210 is spaced apart from the pair of armatures 110, 120 by corresponding gaps therebetween, thus being out of contact with any one of the second ends 110*b*, 120*b* of the pair of armatures 110, 120.

FIG. 7 illustrates a schematic perspective view of the armature assembly 100 and the coil assembly 200 when the coil 220 is not energized; and FIG. 8 illustrates a top view of the armature assembly 100 and the coil assembly 200 as shown in FIG. 7.

As far as the illustrated monostable polar relay is concerned, when the coil 220 is not energized, as illustrated in FIGS. 7 and 8, the armature assembly 100 is rotated to the second position under the action of a magnetic force generated by the magnet 130.

As also shown in FIGS. 7 and 8, in an exemplary embodiment as illustrated, when the armature assembly 100 is located at the second position, i.e., when the coil 220 is not energized, the one end 210*a* of the iron core 210 is configured to be in contact with the first end 110*a* of the first armature 110 of the pair of armatures 110, 120 while the other end 210*b* of the iron core 210 is in contact with the second end 120*b* of the second armature 120 of the pair of armatures 110, 120.

As illustrated in FIGS. 4, 5 and 6, in an exemplary embodiment of the invention, a notch 211 is formed on a side wall of the other end 210*b* of the iron core, such that the other end 210*b* of the iron core 210 is provided to be spaced apart from and thus out of contact with the pair of armatures 110, 120 by the corresponding gaps therebetween, when the armature assembly 100 is located at the first position.

In another exemplary embodiment of the invention, a thickness of the other end 210*b* of the iron core 210 is smaller than that of the one end 210*a* of the iron core 210, such that the other end 210*b* of the iron core 210 is provided to be spaced apart from and thus out of contact with the pair of armatures 110, 120 by the corresponding gaps therebetween.

It should be noticed that, the present invention is not limited to the exemplary embodiments as illustrated, and it is also possible that gaps are established between the other end 210*b* of the iron core 210 and the pair of armatures 110, 120 by bending or cutting the armatures 110, 120.

In an exemplary embodiment as illustrated, as shown in FIGS. 5 and 7, the pivot shaft 150 is arranged to be perpendicular to a bottom surface of the insulation housing, and to extend in a height direction of the polar relay.

In an exemplary embodiment as illustrated, as also shown in FIGS. 5 and 7, the pivot shaft 150 and the pivot hole are configured to be biased toward the other end 210*b* of the iron core 210, relative to geometric center of the armature assembly 100.

In aforementioned embodiments, when the armature assembly 100 is located at the first position, the surfaces of the other end 210*b* of the iron core 210 are spaced apart from facing surfaces of the second ends of the pair of armatures 110, 120 by the corresponding air gaps therebetween. Therefore, it is unnecessary to provide a magnetic isolation plate between the armature and the iron core or to apply an isolation layer onto the armature and the iron core, leading to a decreased cost.

Moreover, in some exemplary embodiments of the invention, the armature assembly is rotatable around a vertical pivot axis, avoiding changing a position of the pivot point during the movement of the iron core, stabilizing the action of the armature assembly and thus ensuring the continuity of the action of the polar relay.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although the disclosure is described in view of the attached drawings, the embodiments disclosed in the drawings are only intended to illustrate the preferable embodiment of the present invention exemplarily, and should not be deemed as a restriction thereof.

Although several exemplary embodiments of the general concept of the present invention have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A polar relay, comprising:

an insulation housing;

an armature assembly mounted in the insulation housing and comprising a pair of armatures, a magnet located between the pair of armatures, and a plastic body holding the pair of armatures and the magnet together; and a coil assembly mounted in the insulation housing, and comprising a coil and an iron core inserted into the coil, one end of the iron core extending between first ends of the pair of armatures while the other end of the iron core extending between second ends of the pair of armatures, wherein the armature assembly is pivotably mounted within the insulation housing such that the armature assembly is rotatable between a first position and a second position; and wherein a thickness of the other end of the iron core is smaller than that of the one end of the iron core, such that the one end of the iron core is in contact with one armature of the pair of armatures while the other end of the iron core is spaced apart from and thus out of contact with the pair of armatures by corresponding gaps therebetween when the armature assembly is located at the first position.

2. The polar relay according to claim 1, wherein the pair of armatures comprises a first armature and a second armature which are arranged to be in parallel with and face each other.

3. The polar relay according to claim 2, wherein the one end of the iron core is in contact with the first armature of the pair of armatures while the other end of the iron core is in contact with the second armature of the pair of armature, when the armature assembly is located at the second position.

4. The polar relay according to claim 3, wherein a notch is formed on a side wall of the other end of the iron core, such that the other end of the iron core is provided to be spaced apart from and thus out of contact with the pair of armatures by the corresponding gaps therebetween, when the armature assembly is located at the first position.

5. The polar relay according to claim 1, wherein a pivot hole is formed in the plastic body of the armature assembly and a pivot shaft is formed on the insulation housing, the pivot shaft being assembled into the pivot hole, such that the armature assembly is rotatable around the pivot shaft between the first position and the second position.

6. The polar relay according to claim 5, wherein the pivot shaft is arranged to be perpendicular to a bottom surface of the insulation housing, and to extend in a height direction of the polar relay.

7. The polar relay according to claim 6, wherein the pivot shaft and the pivot hole are configured to be biased toward the other end of the iron core, relative to geometric center of the armature assembly.

8. The polar relay according to claim 6, wherein the polar relay is a monostable polar relay.

9. The polar relay according to claim 8, wherein the armature assembly is rotated to the second position under the action of a magnetic force generated by the magnet when the coil is not energized.

10. The polar relay according to claim 9, wherein the armature assembly is rotated to the first position under the action of an inductive magnetic force induced by the coil when the coil is energized.

11. The polar relay according to claim 9, wherein the surfaces of the other end of the iron core are spaced apart from facing surfaces of the second ends of the pair of armatures by the corresponding gaps therebetween, when the armature assembly is located at the first position.

12. A polar relay, comprising:

an insulation housing;

an armature assembly mounted in the insulation housing and comprising a pair of armatures, a magnet located between the pair of armatures, and a plastic body holding the pair of armatures and the magnet together; and a coil assembly mounted in the insulation housing, and comprising a coil and an iron core inserted into the coil, one end of the iron core extending between first ends of the pair of armatures while the other end of the iron core extending between second ends of the pair of armatures, wherein the armature assembly is pivotably mounted within the insulation housing such that the armature assembly is rotatable between a first position and a second position; and wherein a notch is formed on a side wall of the other end of the iron core, such that the one end of the iron core is in contact with one armature of the pair of armatures while the other end of the iron core is spaced apart from and thus out of contact with the pair of armatures by corresponding gaps therebetween when the armature assembly is located at the first position.

13. The polar relay according to claim 12, wherein the pair of armatures comprises a first armature and a second armature which are arranged to be in parallel with and face each other.

14. The polar relay according to claim 12, wherein the one end of the iron core is in contact with one armature of the pair of armatures while the other end of the iron core is in contact with another armature of the pair of armatures when the armature assembly is located at the second position.

15. A polar relay, comprising:

an insulation housing having a pivot shaft arranged to be perpendicular to a bottom surface of the insulation housing and extending in a height direction of the polar relay;

an armature assembly mounted in the insulation housing and comprising a pair of armatures, a magnet located between the pair of armatures, and a plastic body holding the pair of armatures and the magnet together, a pivot hole formed in the plastic body; and a coil assembly mounted in the insulation housing, and comprising a coil and an iron core inserted into the coil, one end of the iron core extending between first ends of the pair of armatures while the other end of the iron core extending between second ends of the pair of armatures, wherein the armature assembly is pivotably mounted within the insulation housing such that the armature assembly is rotatable between a first position and a second position, the pivot shaft being assembled into the pivot hole such that the armature assembly is rotatable around the pivot shaft between the first position and the second position, the pivot shaft and the pivot hole configured to be biased toward the other end of the iron core relative to a geometric center of the armature assembly; and wherein the one end of the iron core is in contact with one armature of the pair of armatures while the other end of the iron core is spaced apart from and thus out of contact with the pair of armatures by corresponding gaps therebetween, when the armature assembly is located at one of the first position and the second position.

16. A polar relay, comprising:

an insulation housing having a pivot shaft arranged to be perpendicular to a bottom surface of the insulation housing and extending in a height direction of the polar relay;

an armature assembly mounted in the insulation housing and comprising a pair of armatures, a magnet located between the pair of armatures, and a plastic body holding the pair of armatures and the magnet together, a pivot hole formed in the plastic body; and a coil assembly mounted in the insulation housing, and comprising a coil and an iron core inserted into the coil, one end of the iron core extending between first ends of the pair of armatures while the other end of the iron core extending between second ends of the pair of armatures, wherein the armature assembly is pivotably mounted within the insulation housing such that the armature assembly is rotatable between a first position and a second position, the pivot shaft being assembled into the pivot hole such that the armature assembly is rotatable around the pivot shaft between the first position and the second position;

wherein the one end of the iron core is in contact with one armature of the pair of armatures while the other end of the iron core is spaced apart from and thus out of contact with the pair of armatures by corresponding gaps therebetween, when the armature assembly is located at one of the first position and the second position; and wherein the polar relay is a monostable polar relay.

17. The polar relay according to claim 16, wherein the armature assembly is rotated to the second position under the action of a magnetic force generated by the magnet when the coil is not energized.

18. The polar relay according to claim 17, wherein the armature assembly is rotated to the first position under the action of an inductive magnetic force induced by the coil when the coil is energized.

19. The polar relay according to claim 17, wherein the surfaces of the other end of the iron core are spaced apart from facing surfaces of the second ends of the pair of armatures by the corresponding gaps therebetween, when the armature assembly is located at the first position.

* * * * *